US007029626B2

(12) United States Patent
Beals

(10) Patent No.: US 7,029,626 B2
(45) Date of Patent: Apr. 18, 2006

(54) CREEP RESISTANT MAGNESIUM ALLOY

(75) Inventor: Randy S. Beals, Grand Ledge, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/765,258

(22) Filed: Jan. 26, 2004

(65) Prior Publication Data

US 2005/0112017 A1 May 26, 2005

Related U.S. Application Data

(60) Provisional application No. 60/524,600, filed on Nov. 25, 2003.

(51) Int. Cl.
*C22C 23/02* (2006.01)

(52) U.S. Cl. ..... 420/407; 420/408; 420/409; 420/410; 148/420

(58) Field of Classification Search ..... 420/407–410; 148/420
See application file for complete search history.

(56) References Cited

U.S. PATENT DOCUMENTS 4,997,622 A * 3/1991 Regazzoni et al. ..... 420/407
5,304,260 A * 4/1994 Aikawa et al. ..... 148/403
6,139,651 A 10/2000 Bronfin et al.
6,264,763 B1 7/2001 Powell et al.
6,322,644 B1 11/2001 Pekguleryuz et al.
6,342,180 B1 1/2002 Lefebvre et al.

FOREIGN PATENT DOCUMENTS

EP 1127950 * 8/2001
JP 61003863 * 1/1986
JP 09316586 * 12/1997
WO WO 97/40201 10/1997

OTHER PUBLICATIONS

Oct. 2002: Temperature Behaviour of AJ52X, heat resistant magnesium Alloy for power-train Application; Pierre Labelle, Mihriban Pekgularyuz, D. Argo, M. Lefebvre, R. Bouchard, P. Vermette; Noranda Inc-Technology Centre; Montreal, Quebec, Canada.

* cited by examiner

*Primary Examiner*—Sikyin Ip
(74) *Attorney, Agent, or Firm*—Ralph E. Smith

(57) ABSTRACT

A die castable magnesium based alloy comprising, by weight, between about 3 and 10% aluminum, between about 0.5 and 2.5% calcium, up to about 1.5% silicon, up to about 0.7% zinc, and the remainder being magnesium. The alloy has been found to exhibit more favorable castability and creep resistance than comparative magnesium based alloys.

7 Claims, 10 Drawing Sheets

CREEP RESISTANT MAGNESIUM ALLOY

This application claims the benefit of U.S. Provisional Application No. 60/524,600, filed Nov. 25, 2003.

FIELD OF THE INVENTION

The present invention generally relates to magnesium based alloys and more particularly, to magnesium based casting alloys with improved castability and creep resistance.

BACKGROUND OF THE INVENTION

Magnesium based casting alloys have been utilized extensively in the automotive industry to reduce component weight while providing structural rigidity. As an example, magnesium based alloys have been used to produce transfer cases, transmission cases, oil pans, front engine covers, engine blocks, cam covers, valve covers and cylinder heads.

One drawback associated with some magnesium based alloys is known as creep. Creep occurs when a material continues to deform under constant stress and temperature. Creep resistance is a desirable characteristic for use of magnesium based alloys in power train components. Creep resistance under compressive load and temperature is necessary in order to maintain bolt torque and dimensional stability of cast bodies during vehicle operation. However, known magnesium alloys exhibiting good creep resistance exhibit poor castability and vice versa. Poor castability is indicative of die sticking, oxidation and deficient fluidity and may result in higher production costs during mass production using permanent mold castings.

Yet another drawback to some magnesium based alloys is the conventionally required addition of beryllium to prevent oxidation of the melt.

What is needed therefore, is a magnesium based alloy with both improved creep resistance and castability that does not require the addition of beryllium.

SUMMARY OF THE INVENTION

In accordance with the teachings of the present invention, a family of magnesium based alloys with improved creep resistance and castability includes between about 3% and 10% aluminum, between about 0.5 and 2.5% calcium, up to about 1.5% silicon, up to about 0.7% zinc, with the remainder of the alloy being magnesium.

In another aspect of the invention, the above alloy is made by casting. In yet another aspect of the invention, the above alloy is made by high pressure die casting.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The magnesium based alloy of the present invention contains, by weight, between about 3 and 10% aluminum, between about 0.5 and 2.5% calcium, up to about 1.5% silicon, up to about 0.7% zinc, with the remainder being magnesium, except for impurities commonly found in magnesium alloys. It should be noted that no beryllium is added to the alloy in order to reduce oxidation of the melt.

While the aluminum content is described as preferably between about 3 and 10%, the aluminum content is more preferably between about 4.5 and 5.5% and even more preferably, about 5%.

While the calcium content is described as preferably between about 0.5 and 2.5%, the calcium content is preferably between about 1.5 and 2.5%, and even more preferably about 2%. The presence of calcium in the alloy provides increased creep resistance.

While the silicon content is described as preferably up to about 1.5%, the silicon content is even more preferably between about 0.3 and 0.7 weight percent silicon, and even more preferably about 0.7 weight percent silicon. The presence of silicon in the alloy prevents die sticking and provides for favorable castability.

Functional creep test methods are found in ASTM E139-83. With specific reference to FIGS. 1–10, the results of performing the testing methods are illustrated. In perfomance of these tests, the alloy of the present invention (identified as DCX), and other common magnesium based alloys were cast from the same mold and subjected to several identical tests. The other alloys that were tested were AJ52X, AS31, MRI230D, AS21X, MRI153M, and AXJ530. These well known, commonly available alloys are found in applications such as automotive drive train components.

The weight of the sample casting was measured. The caster took the known amount of weight of the base magnesium AS41 (4% aluminum, 1% silicon, remainder magnesium) and calculated the amount of Cal/Al (75% Calcium 25% aluminum) master alloy to arrive at the intended nominal chemical composition for the DCX alloy. The Cal/Al was then carefully added/stirred into the casting machine melt crucible as to not cause undue slag or oxide build up. During the casting run the melt level drops as the sample castings are produced. Therefore, a known amount of Cal/Al master alloy was added with the addition of the AS 31 ingot as to keep the melt chemistry constant. For example the ingot weight was 17 lbs which then required 0.9 lbs of Cal/Al master alloy to maintain the melt chemical ratio.

Figure 1:
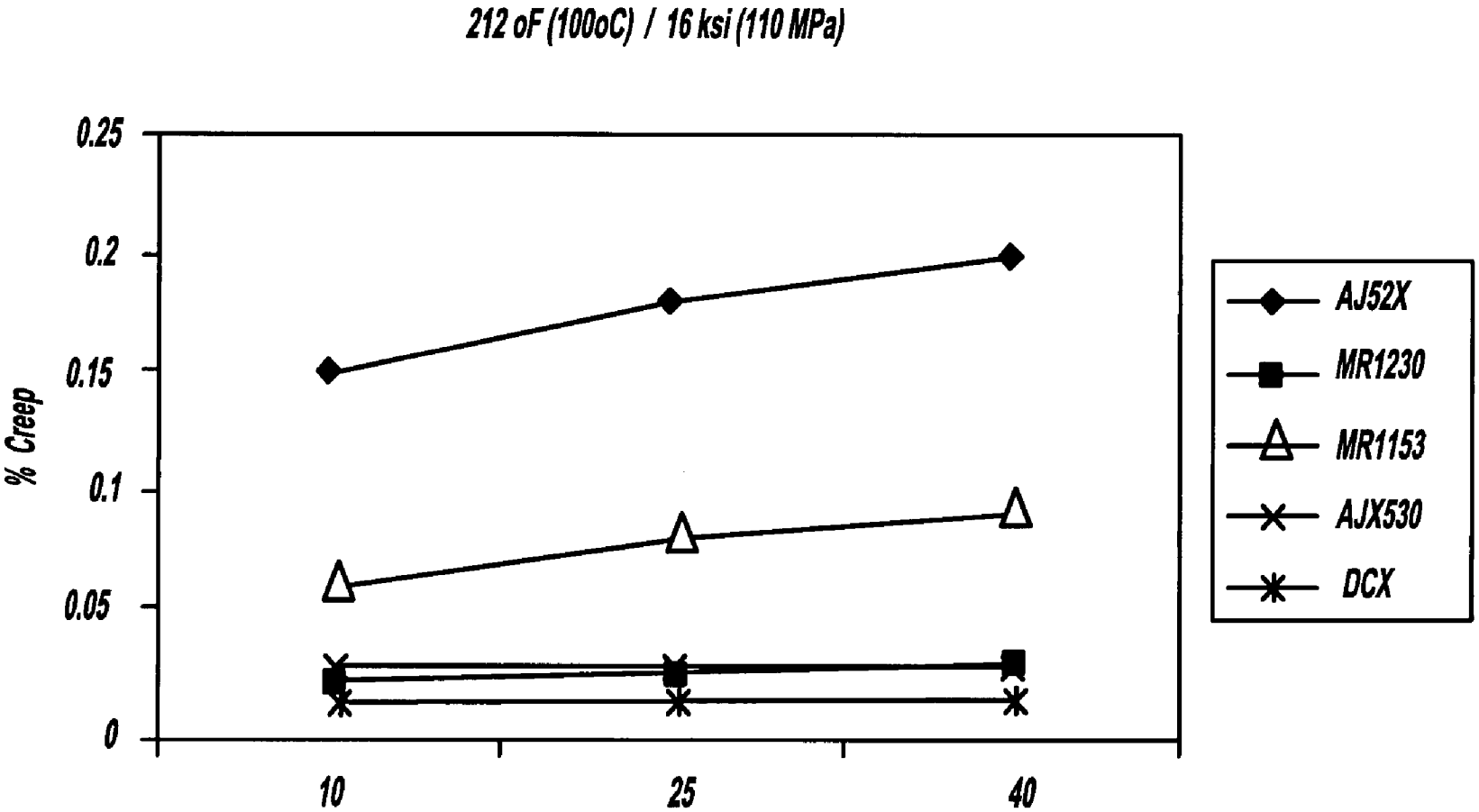
FIG. 1 illustrates the percentage creep of some of the tested alloys at 10, 25, and 40 hours when the castings were subjected to a 110 MPa tensile load while maintained at a constant 100° C.
Figure 2:
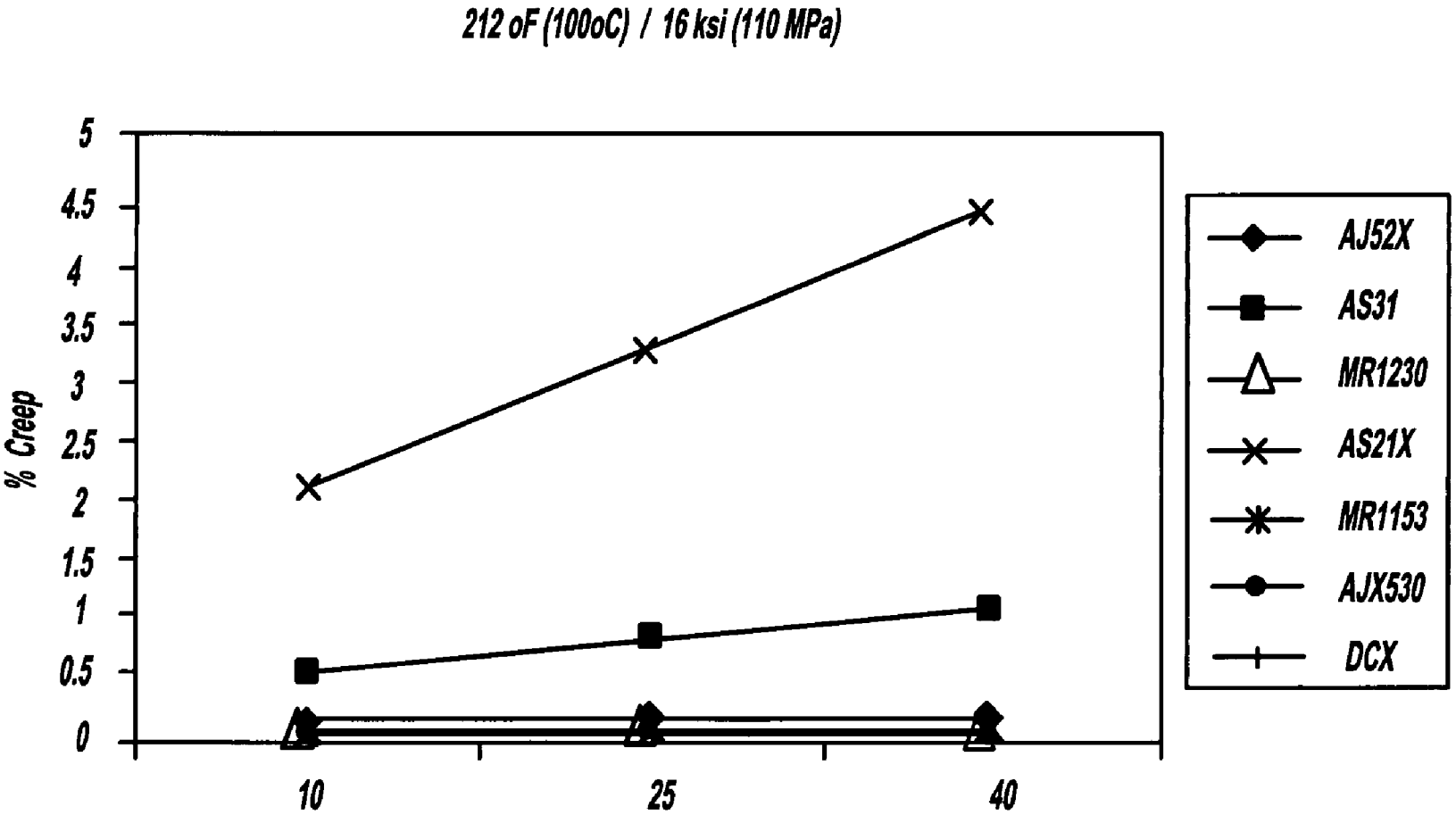
FIG. 2 is similar to FIG. 1 except that additional alloys are included.

With specific reference to FIGS. 1 and 2, the total amount of creep measured during the test is shown to be lower for DCX than for the other alloys. FIGS. 1 and 2 illustrate the creep resistance of alloy DCX at 100° C., which is a typical operating temperature for an automotive drivetrain component such as the outside of an engine block.

Figure 3:
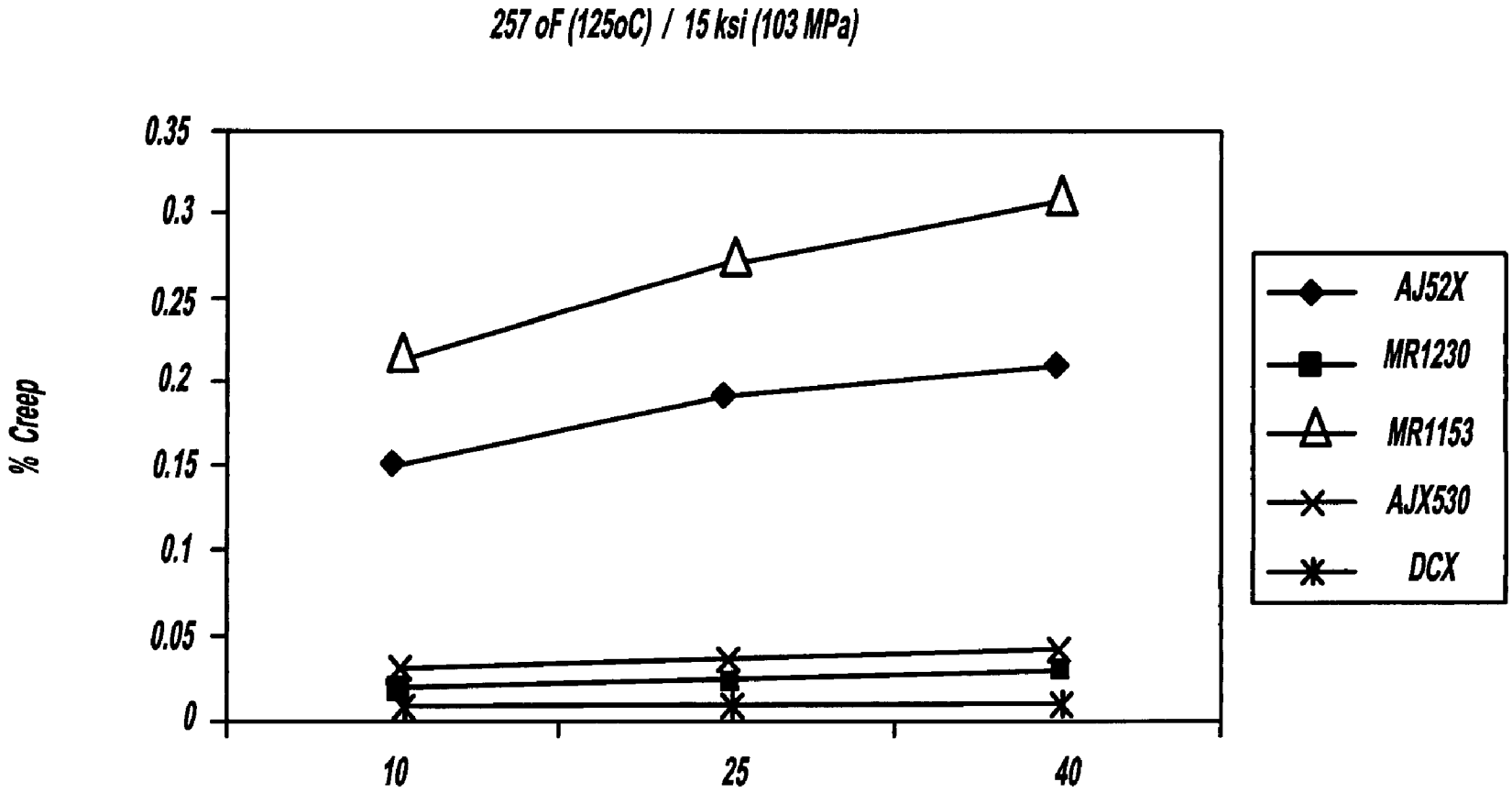
FIG. 3 illustrates the percentage creep of some of the alloys subjected to a comparison test at 10, 25, and 40 hours when the castings were subjected to a 103 MPa tensile load while maintained at a constant 125° C.
Figure 4:
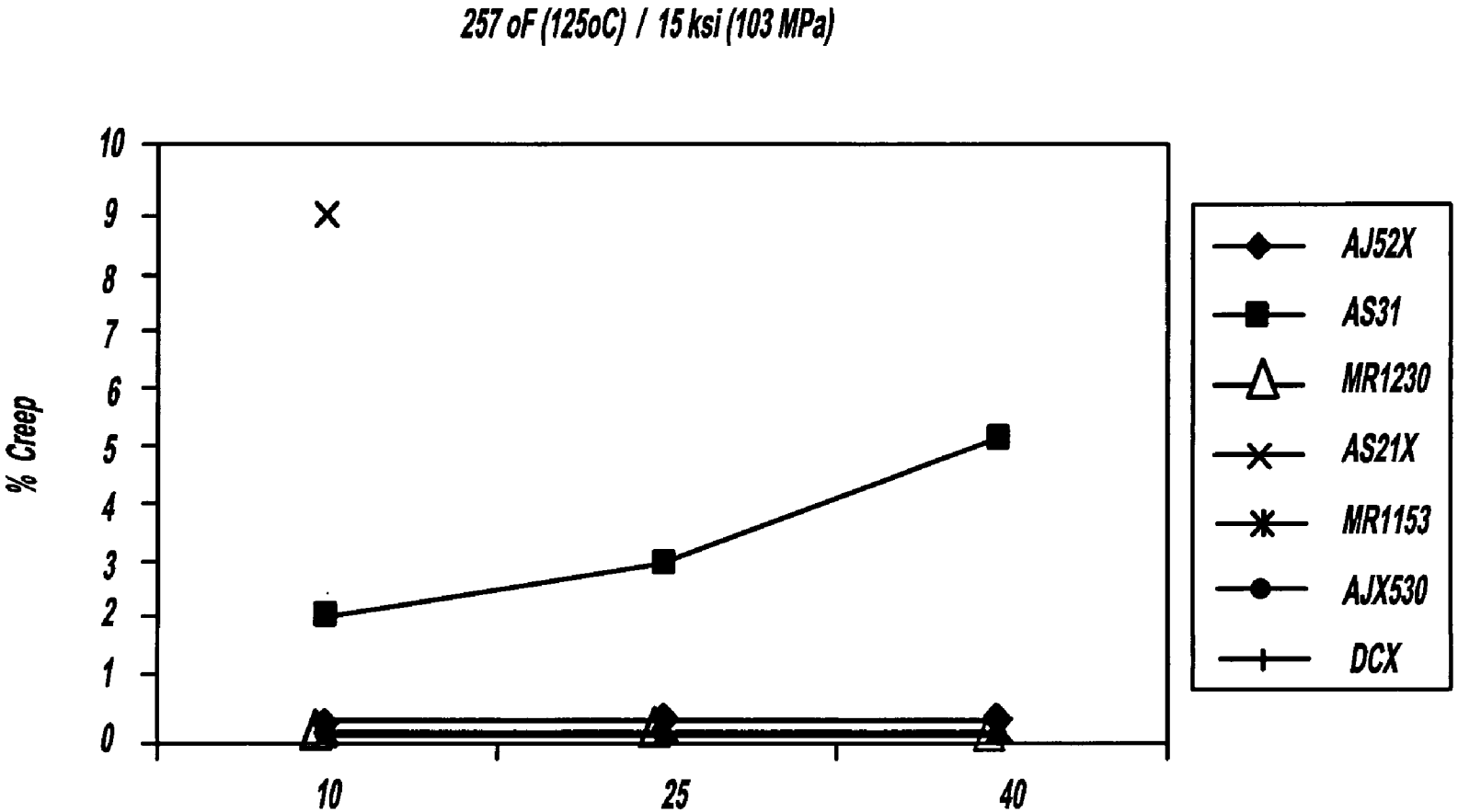
FIG. 4 is similar to FIG. 3, except that additional alloys are included.

FIGS. 3 and 4 illustrate the creep resistance of DCX to be more favorable than the other alloys. The test illustrated in FIGS. 3 and 4 was performed at 125° C. and 103 MPa tensile load. This temperature and stress is typical of the fastener stress and temperature on an engine block.

Figure 5:
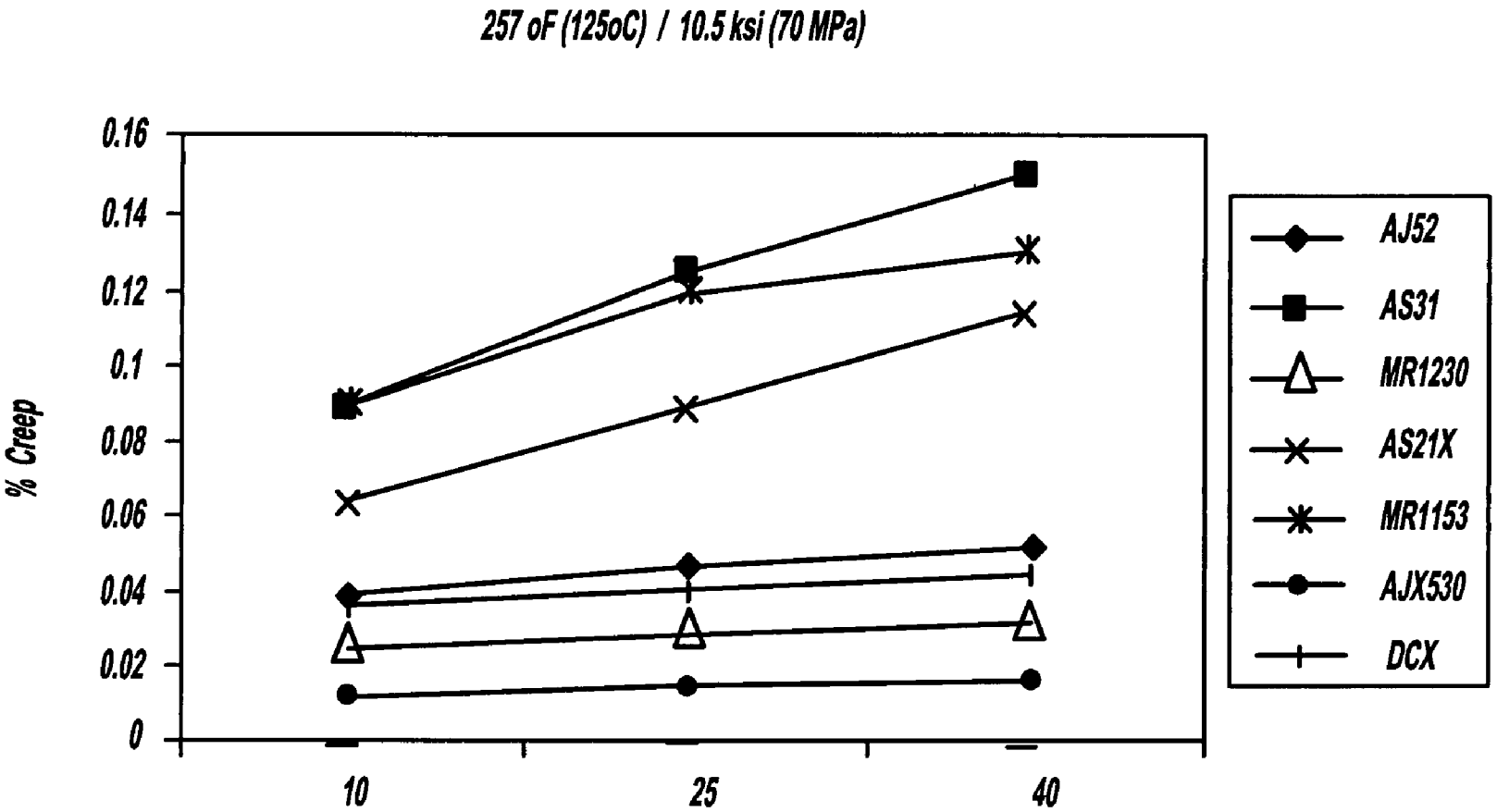
FIG. 5 illustrates the percentage creep of the tested alloys at 10, 25, and 40 hours when the castings were subjected to a 70 MPa tensile load while maintained at a constant 125° C.

FIG. 5 illustrates the creep resistance of DCX to be slightly lower than that of AXJ530 and MRI230, but higher than the other alloys. The test illustrated in FIG. 5 was also performed at 125° C.

Figure 6:
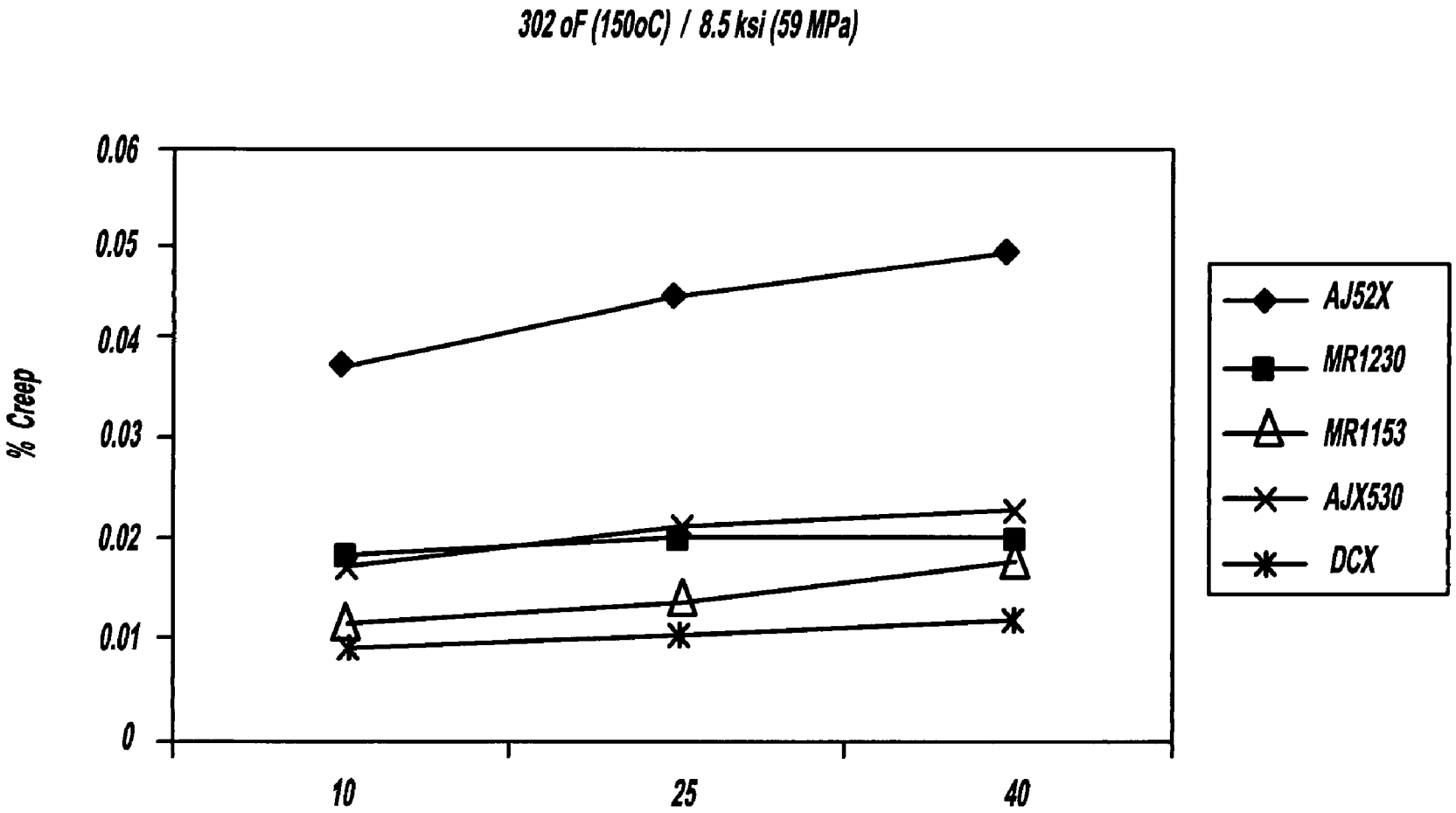
FIG. 6 illustrates the percentage creep of some of the alloys subjected to a comparison test at 10, 25, and 40 hours when the castings were subjected to a 59 MPa tensile load while maintained at a constant 150° C.
Figure 7:
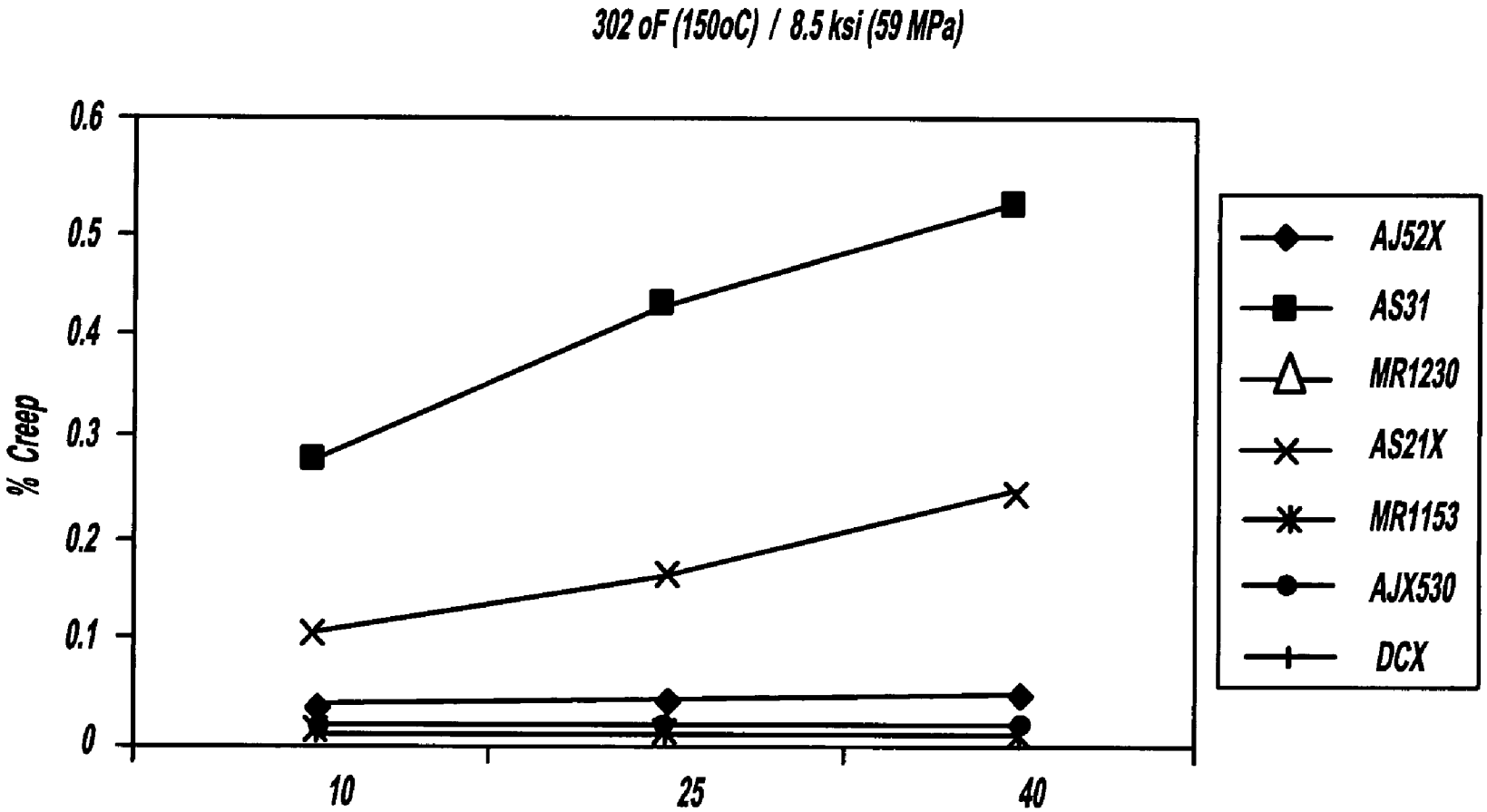
FIG. 7 is similar to FIG. 6, except that additional alloys are included.

FIGS. 6 and 7 illustrate the creep resistance of DCX to be more favorable than the other alloys. The test illustrated in FIGS. 6 and 7 was performed at 150° C. and 59 MPa, which is a typical operating temperature and stress for an automotive transmission case.

Figure 8:
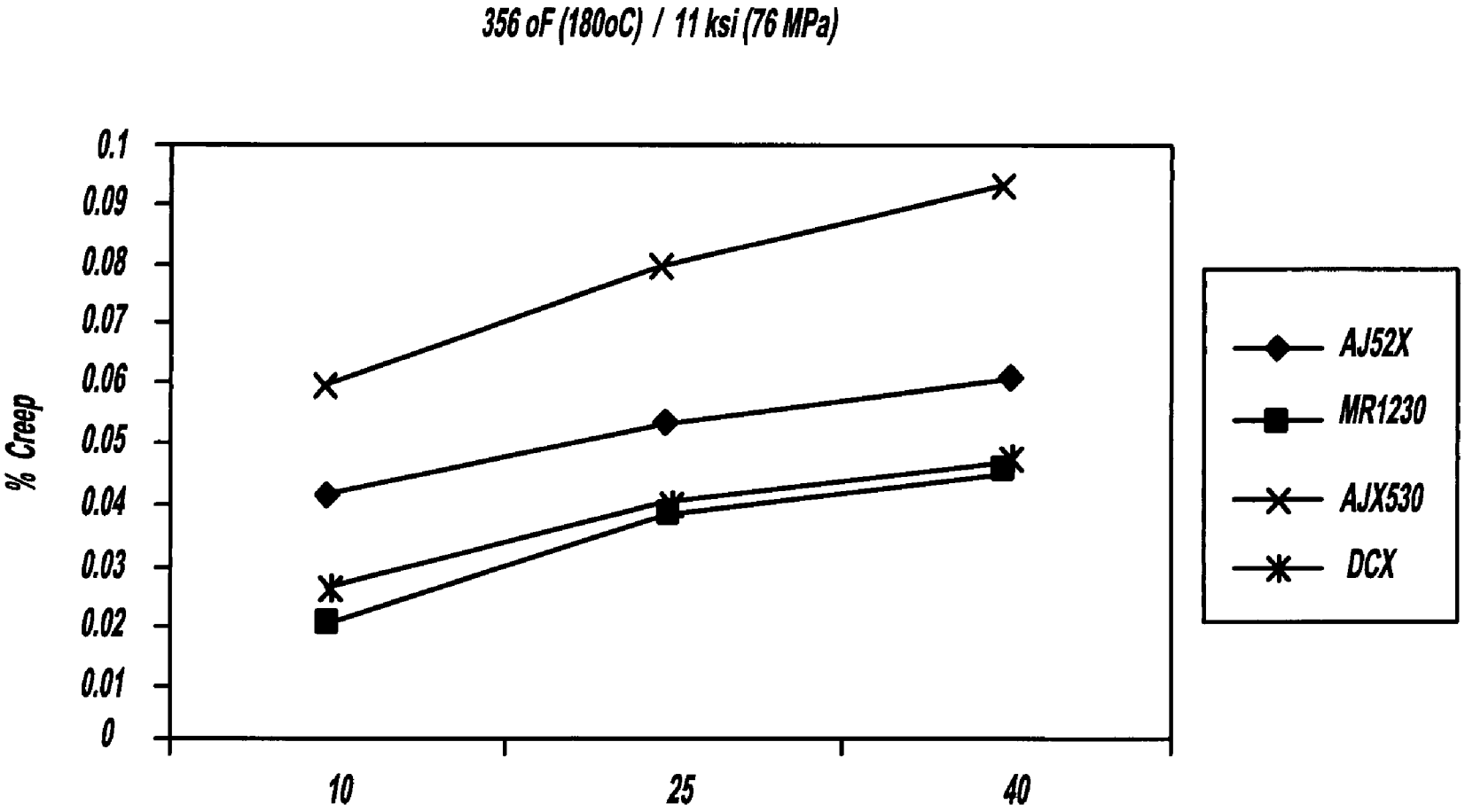
FIG. 8 illustrates the percentage creep of some of the alloys subjected to a comparison test at 10, 25, and 40 hours when the castings were subjected to a 76 MPa tensile load while maintained at a constant 180° C.
Figure 9:
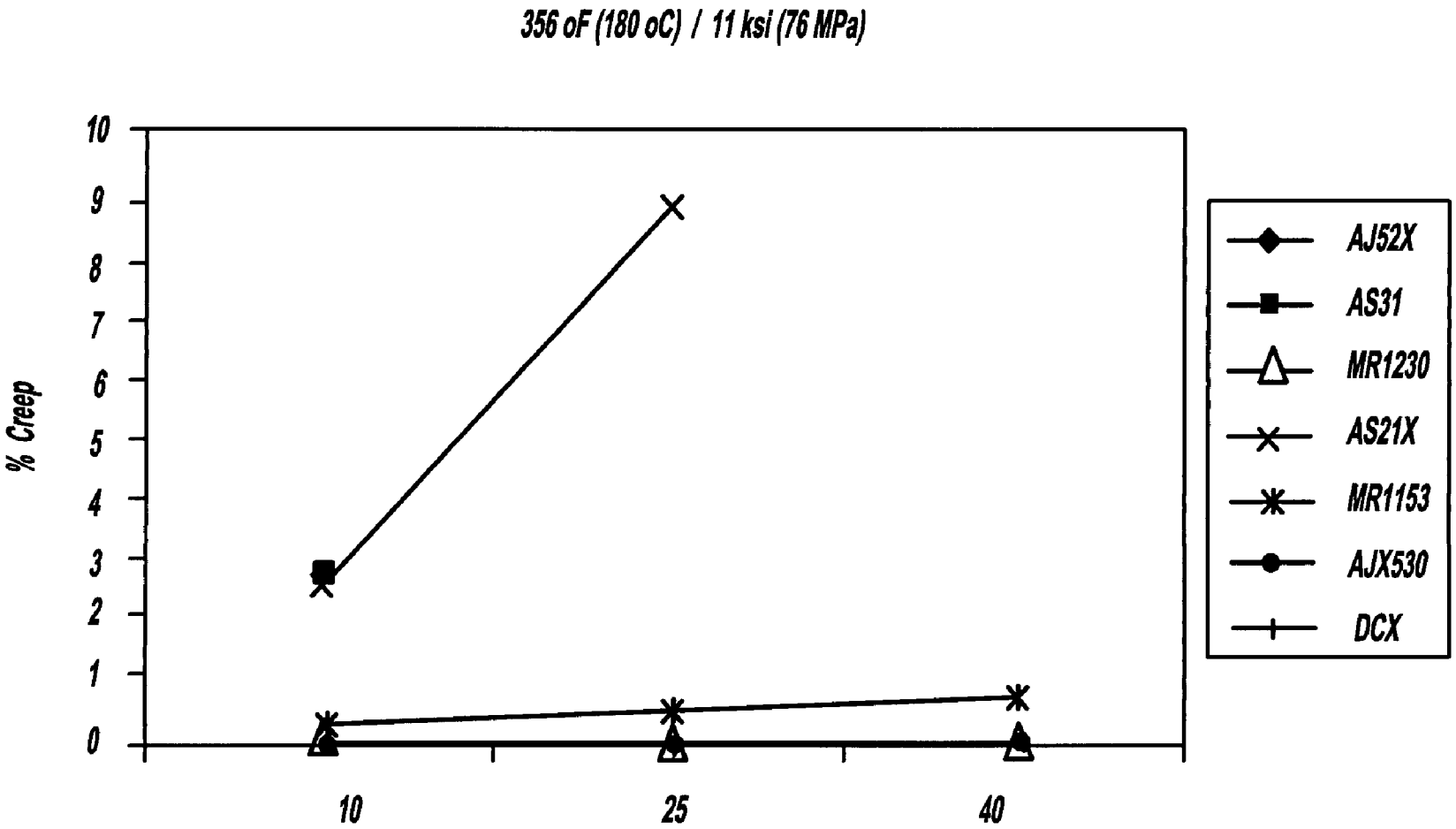
FIG. 9 is similar to FIG. 8, except that additional alloys are included.

FIGS. 8 and 9 illustrate the creep resistance of DCX to be slightly lower than that of MRI230D, but higher than the other alloys. The test illustrated in FIGS. 8 and 9 was performed at 108° C., which is the expected temperature for the block cylinder bore area of an engine.

Figure 10:
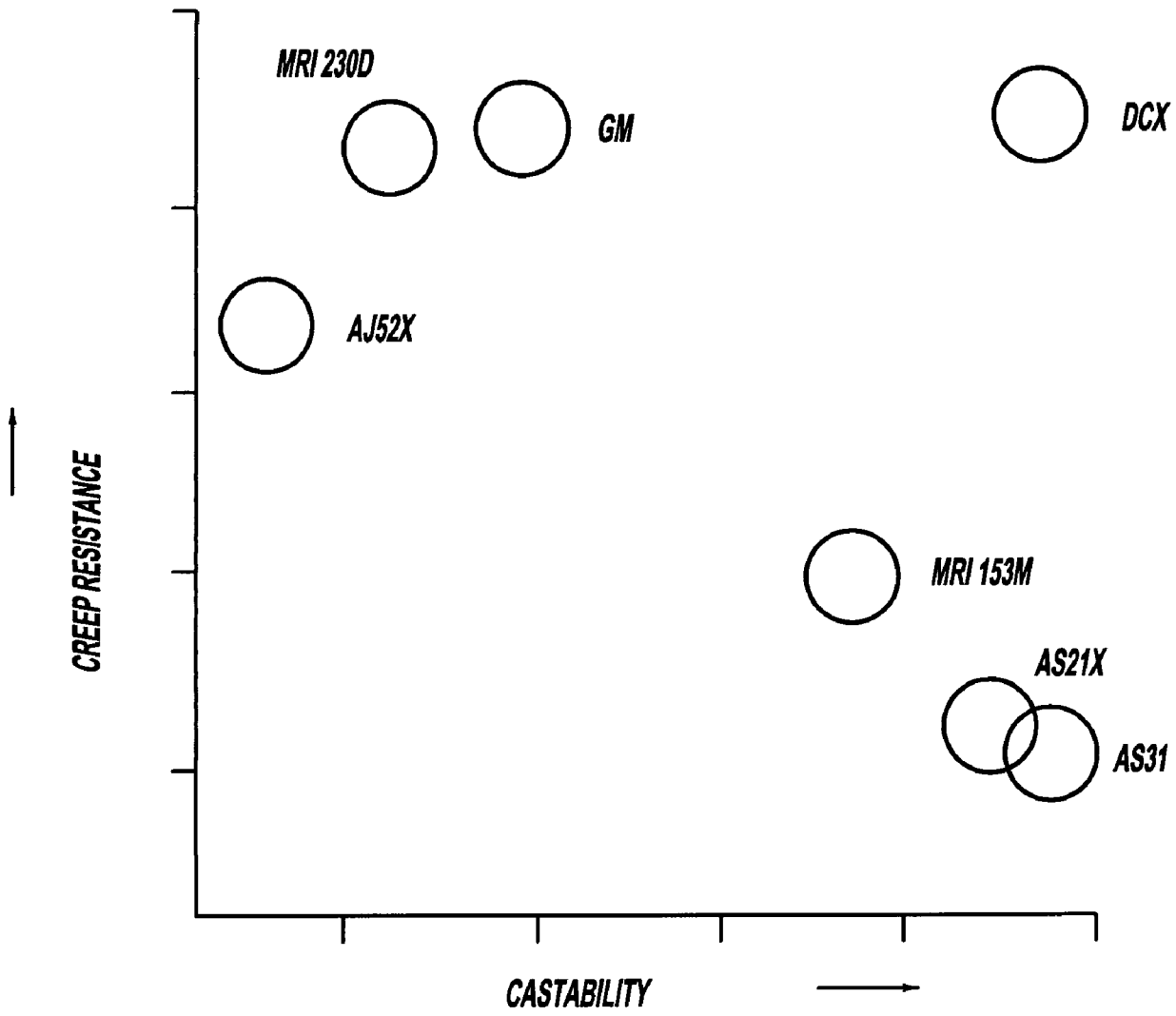
FIG. 10 illustrates a comparison of the creep resistance and castability of the test alloys.

FIG. 10 graphically illustrates the creep resistance and castability of the tested alloys. The castability of the alloys was assessed during casting for the above mentioned tests. Castability is a function of fluidity, oxidation resistance, and die sticking. For mass production of a drivetrain component, castability is a desirable characteristic and a high castability can ensure a more reliable casting process with associated lower costs. As best seen in FIG. 10, the castability of DCX is higher than MRI230D, AJ52X, and AXJ530. The castability of DCX was found to be comparable to that of MRI153M, AS21X, and AS31. When castability and creep resistance are compared simultaneously, DCX is found to have a more favorable combined creep resistance and castability than the other alloys.

In an alternative embodiment of the alloy of the present invention, between about 0.5 and 2.0 weight percent rare earth metals are included. The rare earth metals provide the alloy with additional creep resistance. Preferably, calcium is reduced by about the same amount that rare earth metals are added.

In yet another alternative approach, up to about 1% by weight of tin is added for corrosion resistance.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A creep resistant, castable magnesium alloy consisting of, by weight:

between about 3% and about 10% aluminum;
between about 0.5% and about 2.5% calcium;
between about 0.1% and about 1.5% silicon;
between about 0.1% and about 1% tin; and
up to about 0.7% zinc;
the balance being magnesium, except for impurities commonly found in magnesium alloys.

2. The alloy of claim 1 wherein the weight percentage of aluminum is between about 4.5% and about 5.5%.

3. The alloy of claim 1 wherein the weight percentage of aluminum is about 5%.

4. The alloy of claim 1 wherein the weight percentage of calcium is between about 1.5% and about 2.5%.

5. The alloy of claim 1 wherein the weight percentage of calcium is about 2%.

6. The alloy of claim 1 wherein the weight percentage of silicon is between about 0.3% and about 0.7%.

7. The alloy of claim 1 wherein the weight percentage of silicon is about 0.7%.

* * * * *